US005979651A

United States Patent [19]

Betts

[11] Patent Number: 5,979,651

[45] **Date of Patent: *Nov. 9, 1999**

[54] SELF ADHERING WRAPPER

[76] Inventor: Suzanne Betts, 1376 Anchor Ct., Wantagah, N.Y. 11793

[ * ] Notice: Under 35 U.S.C. 154(b), the term of this patent shall be extended for 134 days.

[21] Appl. No.: 08/549,869

[22] Filed: Oct. 30, 1995

[51] Int. Cl.[6] ..... B65D 73/00

[52] U.S. Cl. ..... 206/457; 206/813; 229/87.19; 229/923

[58] Field of Search ..... 206/457, 813; 229/87.18, 87.19, 922, 923

[56] References Cited

U.S. PATENT DOCUMENTS

| | | | |
|---|---|---|---|
| 2,018,070 | 10/1935 | Kreider, Jr. | 229/923 |
| 2,144,978 | 1/1939 | James | 229/923 |
| 2,144,979 | 1/1939 | James | 229/923 |
| 2,157,194 | 5/1939 | Webber et al. | 229/87.19 |
| 3,489,333 | 1/1970 | Culberg et al. | 229/923 |
| 4,643,452 | 2/1987 | Chang | 283/62 |
| 4,667,829 | 5/1987 | Edmund-White | 206/575 |
| 5,007,229 | 4/1991 | Weder et al. | 229/87.18 |
| 5,337,943 | 8/1994 | Hendren | 229/87.19 |
| 5,414,976 | 5/1995 | Richards | 229/87.19 |
| 5,490,597 | 2/1996 | Schluger | 229/922 |
| 5,505,375 | 4/1996 | Sato et al. | 206/387.1 |

*Primary Examiner*—David T. Fidei
*Assistant Examiner*—Nuan T. Lam

[57] ABSTRACT

A self adhering wrapper including a gift box. The gift box has a bottom wall and a top wall. The top wall and bottom wall have a pair of planar vertical long walls with a pair of opposed planar vertical short walls extended therebetween. A sheet of material is included. The sheet of material has a front surface and a back surface, and is sized to conform to the top wall when positioned over the bottom wall. Included is a pressure sensitive adhesive material. The adhesive material is adhered to the back surface of the sheet material, and forms a continuous adhesive frame about the sheet and with a hollow rectangular interior. Wherein the adhesive material when attached to the gift box, wraps around the top wall and over the bottom wall. This causes portions of the adhesive material to engage and attach to portions of the wrapping material for generally detachably securing the sheet of material.

1 Claim, 3 Drawing Sheets

FIG 3
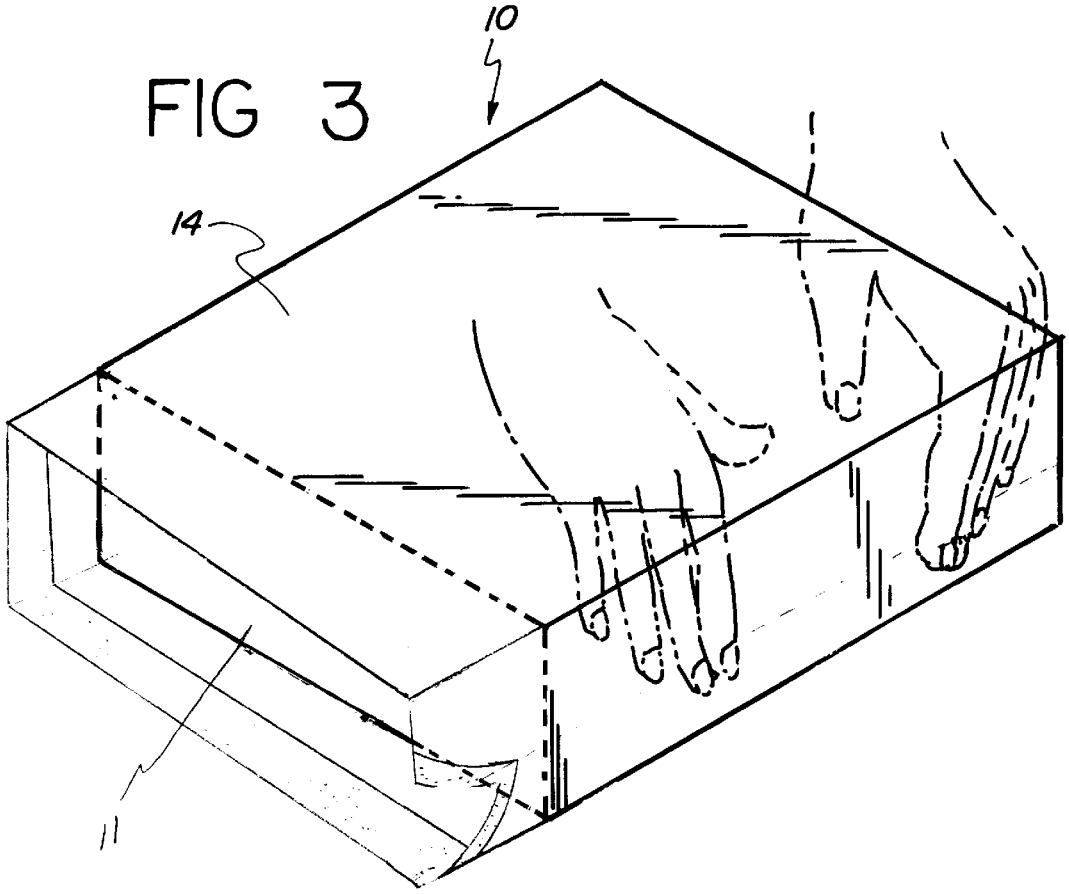
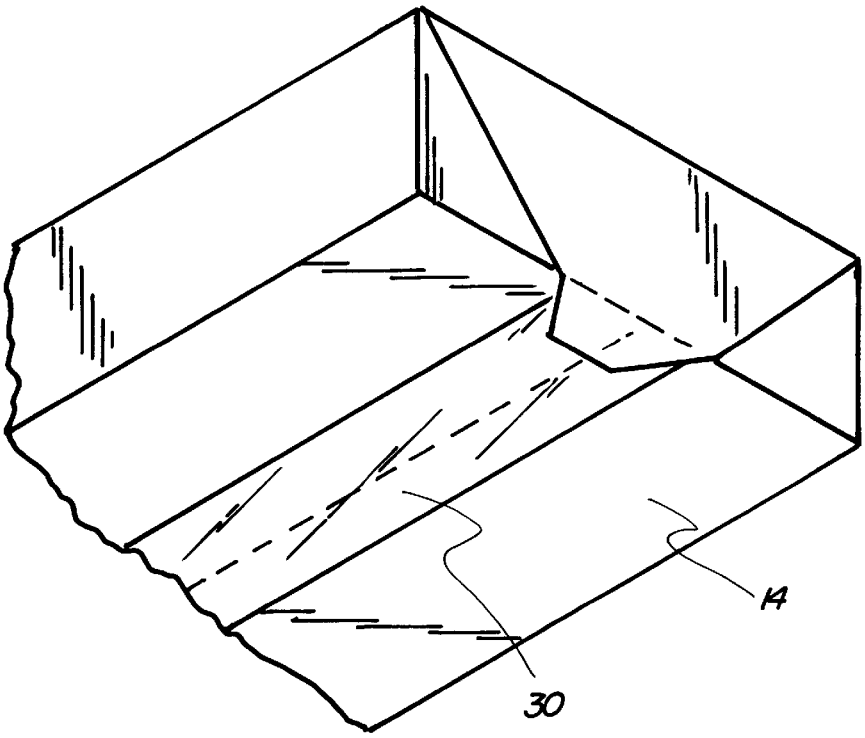
FIG 4

FIG 5
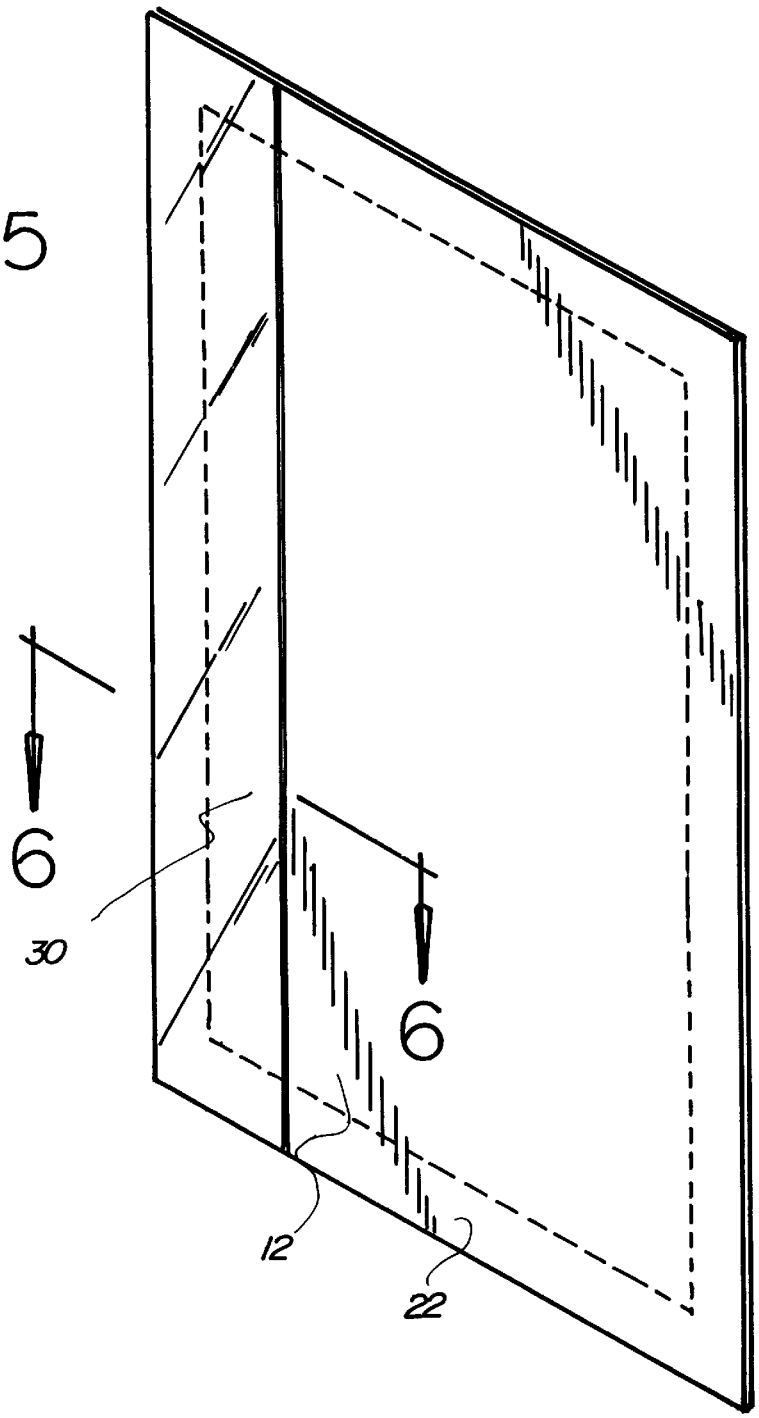
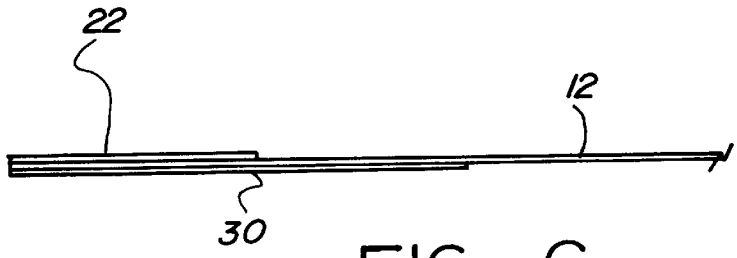
FIG 6

SELF ADHERING WRAPPER

BACKGROUND OF THE INVENTION

1. Field of the Invention

The present invention relates to a self adhering wrapper and more particularly pertains to allowing an item to be placed therein and concealed when the self adhering wrapper is placed in an operable configuration and further allowing reuse of the self adhering wrapper when the adhesive material engages a polymerized strip.

2. Description of the Prior Art

The use of wrapping material is known in the prior art. More specifically, wrapping material heretofore devised and utilized for the purpose of wrapping a variety of items are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,111,638 to Weder discloses a method for wrapping an object with a material having pressure sensitive adhesive thereon. U.S. Pat. No. 5,007,229 to Weder discloses a cling material connected to a portion of the sheet of material so that at least a portion of the cling material extends beyond the outer peripheral surface of the sheet of material. U.S. Pat. No. 4,726,509 discloses a gift wrapping assembly that comprises a box, bow, and ribbon. U.S. Pat. No. 4,508,223 discloses a preformed pot cover package, for slidably receiving a plurality of columns of nested preformed pot covers in slots formed therein. Lastly, U.S. Pat. No. Design 272,103 discloses a sheet of gift wrapping paper showing a specific print design.

While these devices fulfill their respective, particular objectives and requirements, the aforementioned patents do not describe self adhering wrapper that is pre-sized and comes with a container and a sheet of material with an adhesive strip for wrapping a variety of items.

In this respect, the self adhering wrapper according to the present invention substantially departs from the conventional concepts and designs of the prior art, and in doing so provides an apparatus primarily developed for the purpose of allowing an item to be placed therein and concealed when the self adhering wrapper is placed in an operable configuration and further allowing reuse of the self adhering wrapper when the adhesive material engages a polymerized strip.

Therefore, it can be appreciated that there exists a continuing need for a new and improved self adhering wrapper which can be used for allowing an item to be placed therein and concealed when the self adhering wrapper is placed in an operable configuration and further allowing reuse of the self adhering wrapper when the adhesive material engages a polymerized strip. In this regard, the present invention substantially fulfills this need.

SUMMARY OF THE INVENTION

In view of the foregoing disadvantages inherent in the known types of wrapping material now present in the prior art, the present invention provides an improved self adhering wrapper. As such, the general purpose of the present invention, which will be described subsequently in greater detail, is to provide a new and improved self adhering wrapper and method which has all the advantages of the prior art and none of the disadvantages.

To attain this, the present invention essentially includes a gift box. The gift box has a rectangular horizontal bottom wall and a rectangular horizontal top wall, the top wall and bottom wall have a pair of planar vertical long walls with a pair of opposed planar vertical short walls extended therebetween. The gift box is capable of having a variety of items placed therein. Also included is a sheet of flexible material. The sheet has a periphery in a rectangular configuration sized to conform to a variety of box-like structures. Additionally, the sheet of material has a front surface with printing and a back surface without printing. A pressure sensitive adhesive material adhered only to the periphery of the back surface of the sheet material is provided. The adhesive material forms a continuous rectangular adhesive frame with a periphery co-extensive with the periphery of the sheet and a hollow rectangular interior. The continuous rectangular adhesive frame has a width that extends from the periphery toward the hollow rectangular. The width is about between ⅓ inch to ½ inch. The adhesive material attached thereto is wrapped about the gift box. Whereby, portions of the adhesive material contactingly engage and attach to portions of the wrapping material for generally detachably securing of the sheet of material wrapped about at least a portion of the gift box. Included is a detachable attached backing strip releasably adhered over the adhesive portion of the periphery only of the wrapping material. The attached backing strip forms a continuous rectangular frame that has a periphery co-extensive with periphery of the adhesive material and the sheet, and with a hollow rectangular interior. The attached backing is peeled off before positioning of the sheet of flexible material around the gift box. Lastly a protective contact portion adhered is provided. The protective contact portion is only adhered to the periphery of the front surface of the sheet material to form a continuous rectangular protective frame. The protective frame has a periphery co-extensive with the periphery of the sheet and with a hollow rectangular interior. The continuous rectangular protective frame has a width of about ⅓ inch to about ½ inch. Whereby, when the adhesive material is wrapped about the gift box portions of the adhesive material contactingly engages and connects to the protective contact portion to be detachably secured thereabout.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved self adhering wrapper which has all of the advantages of the prior art wrapping material and none of the disadvantages.

It is another object of the present invention to provide a new and improved self adhering wrapper which may be easily and efficiently manufactured and marketed.

It is further object of the present invention to provide a new and improved self adhering wrapper which is of durable and reliable constructions.

An even further object of the present invention is to provide a new and improved self adhering wrapper which is susceptible of a low cost of manufacture with regard to both materials and labor, and which accordingly is then susceptible of low prices of sale to the consuming public, thereby making such self adhering wrapper economically available to the buying public.

Still yet another object of the present invention is to provide a new and improved self adhering wrapper which provides in the apparatuses and methods of the prior art some of the advantages thereof, while simultaneously overcoming some of the disadvantages normally associated therewith.

Even still another object of the present invention is to provide a self adhering wrapper for allowing an item to be placed therein and concealed when the self adhering wrapper is placed in an operable configuration and further allowing reuse of the self adhering wrapper when the adhesive material engages a polymerized strip.

Lastly, it is an object of the present invention to provide a new and improved self adhering wrapper that includes a a gift box. The gift box has a bottom wall and a top wall. The top wall and bottom wall have a pair of planar vertical long walls with a pair of opposed planar vertical short walls extended therebetween. A sheet of material is included. The material has a front surface and a back surface, and sized to conform to the top wall when positioned over the bottom wall. Also included is a pressure sensitive adhesive material. The adhesive material is adhered to the back surface of the sheet material to form a continuous adhesive frame about the sheet and with a hollow rectangular interior. Wherein, the adhesive material when attached to the box, is wrapped about the top wall and over the bottom wall. Whereby portions of the adhesive material contactingly engage and attach to portions of the wrapping material for generally detachably securing the sheet of material.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a perspective view of a gift box covered by the wrapping material shown in FIG. 1, particularly indicating the user folding and attaching the wrapping material securely about the gift box.

FIG. 4 is a partial perspective view of the underside of FIG. 3 showing the adhesive portion of the wrapping material attached and secured to the polymer strip which further promotes easy unattachement of the wrapping material for reuse.

FIG. 5 is a front perspective view of the present invention showing the sheet of material, the adhesive portion around the perimeter of the wrapping material, and the polymer strip.

FIG. 6 is a partial cross-sectional side view taken along line 6—6 showing the layer of adhesive covered by the backing strip, the wrapping material, and the polymer strip.

The same reference numerals refer to the same parts through the various Figures.

DESCRIPTION OF THE PREFERRED EMBODIMENT

Figure 1:
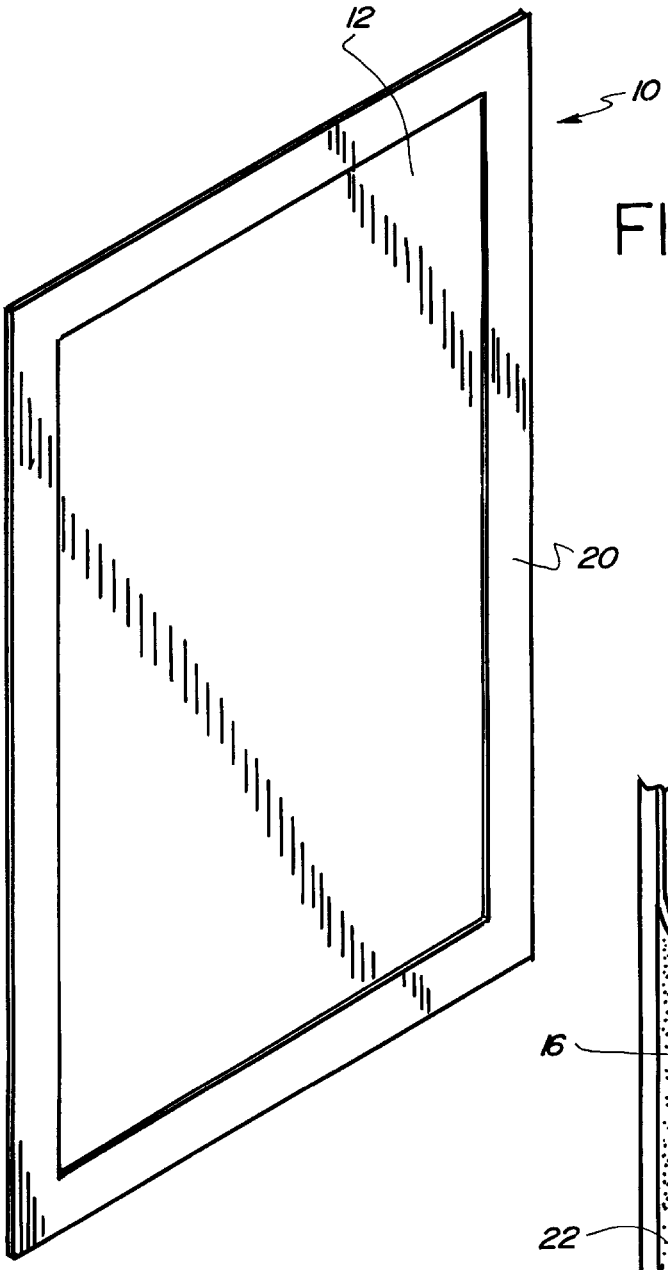
FIG. 1 is a perspective view of showing the back surface of the self adhering wrapper comprising the principles of the present invention.

With reference now to the drawings, and in particular to FIG. 1A thereof, the preferred embodiment of the new and improved self adhering wrapper embodying the principles and concepts of the present invention and generally designated by the reference numeral 10 will be described.

The present invention, the self adhering wrapper 10 is comprised of a plurality of components. Such components in their broadest context include a sheet, a box, an adhesive material, and a backing strip. Such components are individually configured and correlated with respect to each other so as to attain the desired objective.

Specifically, the present invention includes a gift box 11, as shown in FIG. 3. The gift box has a rectangular horizontal bottom wall and a rectangular horizontal top wall. The top wall and bottom wall having a pair of planar vertical long walls with a pair of opposed planar vertical short walls extended therebetween. The gift box is for holding therein a variety of items. The gift box is not limited in shape to a square or rectangular. The structure may be in the form of a cylinder. For the purposes of this application a box structure is shown.

As best illustrated in FIG. 1, a sheet of flexible material 12 is included. The flexible material or wrapping material has a periphery in a rectangular configuration sized to conform to a variety of box-like structures. The sheet of material comprises a front surface 14 with printing and a back surface 16 without printing. The wrapping material is comprised of a suitable material such as cloth, paper, cellophane, foil, man-made organic or polymer films, or combinations thereof. All of the listed materials may be wrapped around any item in a gift box 11.

The wrapping material is of predetermined length, width, and thickness. Generally, the wrapping material is a relatively thin sheet of material retaining sufficient flexibility and fold ability so that the material can be easily shaped by hand about the gift box to be covered. The sheet of material is preferably, but not limited to, a rectangular or square shape to conform to a variety of gift box structures. Examples of popular gift box items as the standard box for blouses and shirts, smaller boxes for jewelry, and shoe boxes.

Figure 2:
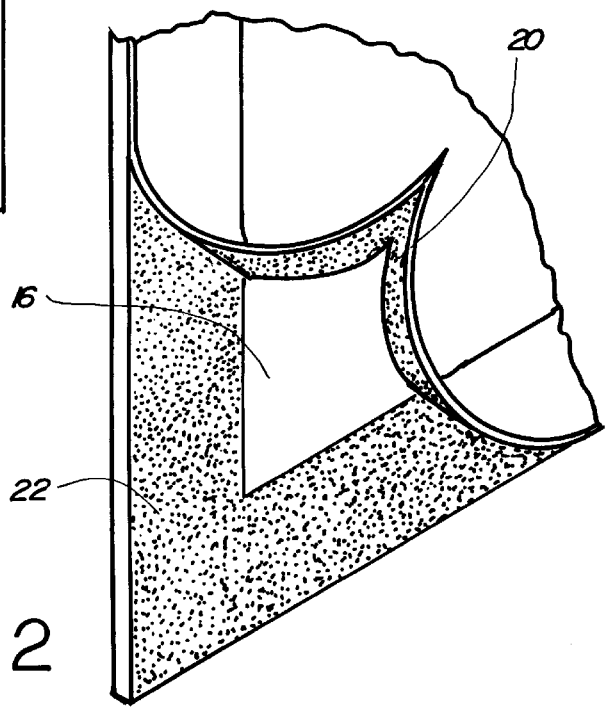
FIG. 2 is an enlarged partial perspective view of the present invention, particularly showing the backing strip being removed off the adhesive portion.

A pressure sensitive adhesive material 22 is provided. The adhesive material is permanently adhered only to the periphery of the back surface of the sheet material. The adhesive material, as shown in FIG. 2, forms a continuous rectangular adhesive frame having a periphery co-extensive with the periphery of the sheet and with a hollow rectangular interior. The continuous rectangular adhesive frame has a width that extends from the periphery toward the hollow rectangular with the width being about between ⅓ inch to ½ inch. The adhesive material attached thereto is wrapped about the gift box, whereby portions of the adhesive material engage and attach to portions of the wrapping material for detachably securing the sheet of material wrapped about at least a portion of the gift box.

The bonding occurs as the adhesive material connects to portions of the wrapping material or the gift box. The adhesive materials, while permanently adhered to the back surface of the sheet material is being wrapped. The adhesive material is made of conventional type adhesives such as synthetic or natural adhesive materials that are capable of temporarily bonding to other surfaces. The types of adhesives that may be used are easily removed after bonding to a surface without tearing that surface.

Furthermore, a detachable attached backing strip 20 is provided. The detachable attached backing strip is releasably adhered over the adhesive portion of the periphery of the wrapping material and forms a continuous rectangular frame. The continuous rectangular frame of the strip has a periphery co-extensive with periphery of the adhesive material and the sheet and with a hollow rectangular interior. The detachable strip, as shown in FIG. 2, is peeled off before positioning of the sheet of flexible material around the gift box. The backing strip protects the adhesive portion before use of the wrapping material and is unique to the present invention.

Lastly, a protective contact portion 30 is provided, as shown in FIG. 4. The protective contact portion is adhered only to the periphery of the front surface of the sheet material. The protective contact portion forms a rectangular protective frame that has a periphery co-extensive with the periphery of one side of the sheet. The protective contact portion is made from a polymer strip. The continuous rectangular protective frame has a width of about ⅓ inch to about ½ inch. Whereby, when the adhesive material is wrapped about the box-like structure portions of the adhesive material contactingly engages and connects to the protective contact portion to be detachably secured thereabout.

The wrapping of items within the self adhering wrapper allows for repeated use of the wrapping material and gift box. Once the adhesive material is attached on a surface during the wrapping process, but : in particular attached to the protective contact portion, it is easily unattached and allows the self adhering wrapper to be reused. Additionally, usage of the self adhering wrapper conserves paper, eliminates the use of tape, and thereby helps the environment.

Shown diagrammatically in FIG. 3, the flexible sheet has completely covered the gift box. In particular, the user is shown folding and attaching the wrapping material to securely and detachably wrap the gift box. The pressure sensitive adhesive material is bondable by the application of a slight pressure such as might be imposed by the hand of the user.

FIG. 5 shown the front surface of the sheet of material. An example of the adhesive area is outlined. The protective contact portion is shown along one side of the sheet. FIG. 6 is a partial L cross-sectional view of FIG. 5 showing the layer of adhesive material, the sheet of wrapping material layer, and the protective contact portion.

The present invention is a self adhering wrapper that has a sheet of flexible material sized to conform to the box-like structure provided. The sheet of material has an adhesive material framed on the back surface of the sheet. A detachable attached backing strip is adhered over the adhesive material. The backing strip protects the adhesive material from dirt and dust, and ensures that it remains in a usable condition.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved self adhering wrapper system for wrapping items placed therein comprising in combination:

a gift box having a rectangular horizontal bottom wall and a rectangular horizontal top wall, the top wall and bottom wall having a pair of planar vertical long walls with a pair of opposed planar vertical short walls extended therebetween, the gift box being capable of having placed therein a variety of items;

a sheet of flexible material having a periphery in a rectangular configuration sized to conform to the gift box wherein the sheet of material comprises a front surface with printing and a back surface without printing;

a pressure sensitive adhesive material adhered only to the periphery of the back surface of the sheet material to thereby form a continuous uninterrupted rectangular adhesive frame having a periphery co-extensive with the periphery of the sheet and with a hollow rectangular interior, the continuous rectangular adhesive frame having a width that extend from the periphery toward the hollow rectangular interior with the width being about between ⅓ inch to ½ inch, wherein the adhesive material attached thereto is wrapped about the gift box whereby portions of the adhesive material contactingly engage and attach to portions of the wrapping material for generally detachably securing the sheet of material wrapped about at least a portion of the gift box;

a continuous un interrupted detachable attached backing strip releasably adhered over the adhesive portion of the periphery only of the wrapping material to thereby form a continuous rectangular frame having a periphery co-extensive with periphery of the adhesive material and the sheet and with a hollow rectangular interior for peeling off before positioning of the sheet of flexible material around the gift box; and a protective contact portion adhered only to the periphery of the front surface of the sheet material to thereby form a rectangular protective frame having a periphery co-extensive with the periphery of at least one side of the sheet, the rectangular protective frame having a width of about ⅓ inch to about ½ inch, whereby when the adhesive material is wrapped about the gift box portions of the adhesive material contactingly engages and connects to the protective contact portion to be detachably secured thereabout.

* * * * *